US009834360B2

(12) United States Patent
Tanaka et al.

(10) Patent No.: US 9,834,360 B2
(45) Date of Patent: Dec. 5, 2017

(54) IMPLEMENT FOR CONSTANT-TEMPERATURE STORAGE AND STORAGE CONTAINER HOUSING THE SAME

(71) Applicant: TOPPAN FORMS CO., LTD., Tokyo (JP)

(72) Inventors: Yasuhiro Tanaka, Tokyo (JP); Sho Morita, Tokyo (JP)

(73) Assignee: TOPPAN FORMS CO., LTD., Tokyo (JP)

( * ) Notice: Subject to any disclaimer, the term of this patent is extended or adjusted under 35 U.S.C. 154(b) by 151 days.

(21) Appl. No.: 14/655,963

(22) PCT Filed: Jan. 9, 2013

(86) PCT No.: PCT/JP2013/050139

§ 371 (c)(1),
(2) Date: Jun. 26, 2015

(87) PCT Pub. No.: WO2014/103344

PCT Pub. Date: Jul. 3, 2014

(65) Prior Publication Data

US 2015/0330697 A1 Nov. 19, 2015

(30) Foreign Application Priority Data

Dec. 27, 2012 (JP) ..... 2012-285401

(51) Int. Cl.

| | |
|---|---|
| ***F25D 3/08*** | (2006.01) |
| ***B65D 81/18*** | (2006.01) |
| ***B65D 81/38*** | (2006.01) |

(52) U.S. Cl.
CPC ..... *B65D 81/18* (2013.01); *B65D 81/3813* (2013.01); *B65D 81/3825* (2013.01);
(Continued)

(58) Field of Classification Search
CPC ..... F25D 2331/804; F25D 3/08
(Continued)

(56) References Cited

U.S. PATENT DOCUMENTS 5,329,787 A * 7/1994 Friday ..... F25D 3/08 62/372
5,533,361 A * 7/1996 Halpern ..... B62B 3/1464 62/371
(Continued)

FOREIGN PATENT DOCUMENTS

JP S60-15862 U 2/1985
JP 2007-263537 A 10/2007
(Continued)

OTHER PUBLICATIONS

Office Action dated Aug. 26, 2016 from Taiwanese counterpart application No. 10521064930.

*Primary Examiner* — Melvin Jones
(74) *Attorney, Agent, or Firm* — Knobbe Martens Olson & Bear LLP

(57) ABSTRACT

An implement for storage at a constant temperature has two housings (21 and 22) that accommodate heat storage agents. One heat storage agent (41) is irremovably accommodated in one housing (21), and a hook-and-loop fastener (30) for installation in a storage container is provided on the outer surface of the other housing (22).

6 Claims, 6 Drawing Sheets

(52) U.S. Cl.
CPC ..... *F25D 3/08* (2013.01); *F25D 2303/0843* (2013.01); *F25D 2303/08221* (2013.01); *F25D 2331/804* (2013.01)

(58) Field of Classification Search
USPC ..... 62/371, 457.1, 457.2, 530
See application file for complete search history.

(56) References Cited

U.S. PATENT DOCUMENTS

| | | | | |
|---|---|---|---|---|
| 6,119,476 | A * | 9/2000 | Slaughter | A01K 63/02 62/371 |
| 6,212,901 | B1 * | 4/2001 | Pint | B65D 81/382 62/265 |
| 6,427,475 | B1 | 8/2002 | DeFelice et al. | |
| 7,784,301 | B2 * | 8/2010 | Sasaki | B65D 11/18 229/103.11 |
| 2003/0101743 | A1 | 6/2003 | Defelice et al. | |
| 2007/0151283 | A1 | 7/2007 | Whewell | |
| 2009/0178437 | A1 | 7/2009 | Mak | |
| 2011/0009931 | A1 | 1/2011 | Hong | |

FOREIGN PATENT DOCUMENTS

| | | |
|---|---|---|
| JP | 1433322 | 2/2012 |
| TW | M374343 U1 | 2/2010 |

* cited by examiner

IMPLEMENT FOR CONSTANT-TEMPERATURE STORAGE AND STORAGE CONTAINER HOUSING THE SAME

CROSS-REFERENCE TO RELATED APPLICATIONS

This application is the U.S. National Phase under 35. U.S.C. §371 of International Application PCT/JP2013/050139, filed Jan. 7, 2013, which claims priority to Japanese Patent Application No. 2012-285401, filed Dec. 27, 2012. The disclosures of the above-described applications are hereby incorporated by reference in their entirety.

TECHNICAL FIELD

The present invention relates to an implement for constant-temperature storage that uses a heat storage agent to store a stored article at constant temperature, and more particularly relates to an implement for constant-temperature storage that uses two heat storage agents to store a stored article at constant temperature.

BACKGROUND ART

The cooling of stored articles such as food products is conventionally realized by using a heat storage agent. A typically used heat storage agent has a melting point below 0° C., and for example, is first cooled at a low temperature in the order of −25° C. in a freezer and then removed for use. When freezing the heat storage agent, the heat storage agent is typically frozen in an environment that is at least 10° C. lower than its freezing point, and even a heat storage agent having a melting point in the vicinity of 0° C. is frequently frozen in an environment of −25° C. As a consequence, when the heat storage agent is used immediately after having been removed from a freezer, the stored article will be cooled to below 0° C.

Stored articles that are cooled using heat storage agents in this way include such articles as specimens that are preferably cooled to the level of 2-8° C. and that are preferably not cooled to 0° C. or below. When such a stored article is to be kept cool, the heat storage agent is first removed from the freezer and then left for 30 minutes to three hours at room temperature or in a refrigerator to raise the temperature of the heat storage agent to the melting point. However, removing the heat storage agent from the freezer and leaving it out for a certain time after removal is not efficient and does not allow immediate use when its use is desired.

Here, a solution can be considered in which two heat storage agents are used so as not to excessively cool a stored article. In this case, if two heat storage agents are arranged one over the other and a state is established in which the heat storage agent on the side away from the stored article is frozen and the heat storage agent on the side of the stored article is not frozen, the stored article will be indirectly cooled by the heat storage agent that is frozen by way of the heat storage agent that is not frozen. In this way, the temperature of the stored article will not fall below the freezing point of the heat storage agent that is not frozen, and excessive cooling of the stored article can thus be avoided.

In the opposite circumstances of use in a cold district, the above-described heat storage agent is used to keep a stored article at a desired temperature that is higher than the outside temperature, and in this case, the stored article can be kept at a desired temperature that is higher than the outside temperature by arranging the two heat storage agents superposed as described above and by establishing a state in which the heat storage agent on the side away from the stored article is not frozen and the heat storage agent on the side of the stored article is frozen.

An implement for constant-temperature storage in which two heat storage agents are superposed in this way to keep a stored article at a constant temperature is disclosed in, for example, Patent Document 1 . This constant-temperature storage implement is not only constructed so as to allow installation on the inside wall surface of a storage container that holds the stored article but also includes a double-layer pocket that can accommodate heat storage agents. The stored article can be stored at a desired temperature by placing each heat storage agent in a respective pocket and by establishing a state in which either the heat storage agent on the side of the stored article or the heat storage agent on the side away from the stored article is frozen and the other heat storage agent is not frozen, as described hereinabove.

LITERATURE OF THE PRIOR ART

Patent Documents

Patent Document 1: Design Registration No 1433322

SUMMARY OF THE INVENTION

Problem to be Solved by the Invention

However, in an implement for constant-temperature storage such as described above, because a heat storage agent that is frozen is accommodated in one of the two layers of pockets and a heat storage agent that is not frozen is accommodated in the other layer, the concern arises that the heat storage agents may be inserted in the wrong pocket, and if inserted in the wrong pocket, storage of the stored article at the desired temperature will no longer be possible. Furthermore, when the constant temperature storage implement is installed on the inside wall of the storage container, there is a concern that an error may occur in the installation orientation, in which case the arrangement of the heat storage agent that is frozen and the heat storage agent that is not frozen will be the reverse of the desired arrangement even though the heat storage agent that is frozen and the heat storage agent that is not frozen have been inserted correctly as described above, and as a result, storage of the stored article at the desired temperature will no longer be possible as described above.

The present invention was realized to address the problems inherent to the above described prior art, and its object is to provide an implement for constant-temperature storage and a storage container in which, this implement, after installation, can avoid incorrect positioning of the two heat storage agents with respect to the stored article, when the two heat storage agents are arranged superimposed for the purpose of storing a stored article at constant temperature.

Means for Solving the Problem

To achieve the above-described object, the present invention is an implement for constant-temperature storage that is installed on the inside wall surface of a storage container that accommodates the stored article, the implement for constant-temperature storage including:

a first housing in which a first heat storage agent is irremovably accommodated; and a second housing that is adjacent to a side of said inside wall surface of said first housing when the implement for constant-temperature storage is installed in said storage container and in which a second heat storage agent is removably accommodated;

wherein said second housing is provided with installation parts on the outer surface of the side that is opposite said first housing in order to install said implement for constant-temperature storage in said storage container.

In the present invention that is configured as described above, the implement for constant-temperature storage is installed in the storage container by means of installation parts that are provided on the outer surface of, of the first housing and second housing that accommodate heat storage agents for storing a stored article at a constant temperature, the second housing on the side that is opposite that of the first housing, and as a result, there is no possibility of incorrect orientation with respect to the storage container. In addition, the first heat storage agent is irremovably accommodated in the first housing and only the second heat storage agent needs be placed in the second housing at the time of use, and as a result, when a state is set in which the first heat storage agent or the second heat storage agent is in an unfrozen state and the other is in a frozen state in order to store the stored article at a desired temperature, there is no possibility of incorrectly placing this unfrozen heat storage agent and frozen heat storage agent in the first housing and second housing. In addition, because the implement for constant-temperature storage is installed in the storage container in the correct orientation as described above, and moreover, because there is no possibility of incorrect placement of the heat storage agents in the first housing and second housing, there is no possibility that the two heat storage agents will be incorrectly positioned with respect to the stored article.

In addition, if the first heat storage agent has a cushioning property and the surface of the first housing that is on the side opposite that of the second housing is flexible, not only can the stored article be protected from shocks, but the first heat storage agent will be in close contact with the outer surface of the stored article by way of the first housing, whereby the constant-temperature storage effect will be improved.

Effect of the Invention

According to the present invention, the first heat storage agent is irremovably accommodated in the first housing, the second housing is provided with installation parts on the outer surface for installation in the storage container, and at the time of use, the second heat storage agent is placed in the second housing and the implement for constant-temperature storage is then installed in the storage container by means of the installation parts, and as a result, any incorrect positioning of the two heat storage agents, with respect to the stored article, can be avoided.

In addition, in a configuration in which the first heat storage agent has a cushioning property and the surface of the side of the first housing that is opposite that of the second housing is flexible, not only can the stored article be protected from shocks, but the first heat storage agent will be in close contact with the outer surface of the stored article by way of the first housing, whereby the constant-temperature storage effect will be improved.

BEST MODE FOR CARRYING OUT THE INVENTION

Exemplary embodiments of the present invention are next described with reference to the accompanying drawings.

Figure 1A:
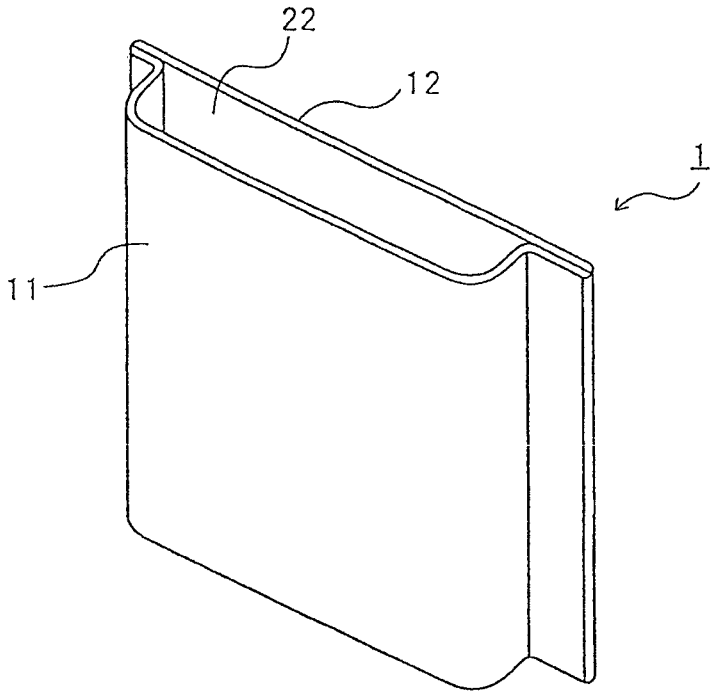
FIG. 1*a* is an outer perspective view showing an exemplary embodiment of the implement for constant-temperature storage of the present invention.
Figure 1B:
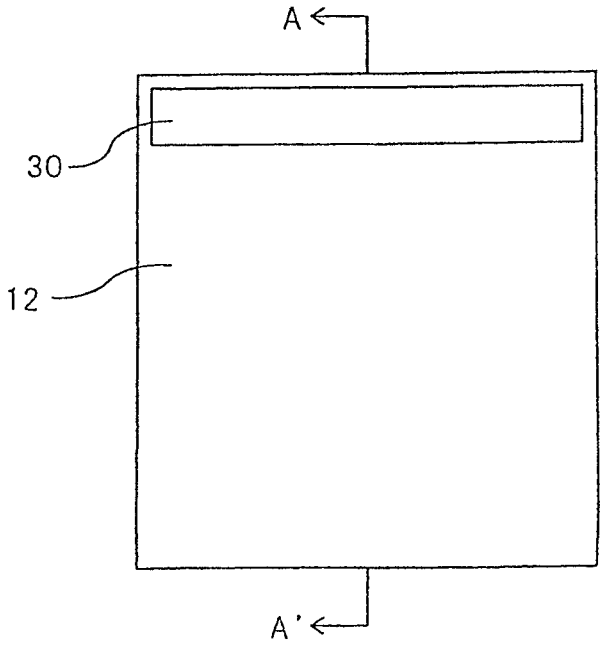
FIG. 1*b* is a view as seen from the rear side of the implement for constant-temperature storage shown in FIG. 1*a*.
Figure 1C:
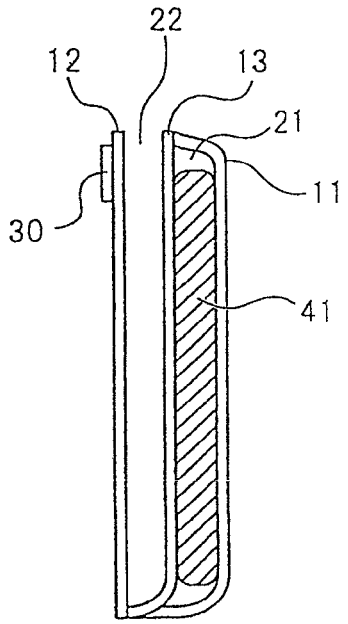
FIG. 1*c* is a sectional view taken along line A-A' shown in FIG. 1*b*.

FIG. 1*a* is an outer perspective view showing an exemplary embodiment of the implement for constant-temperature storage of the present invention, FIG. 1*b* is a view of implement for constant-temperature storage 1 shown in FIG. 1*a* as seen from the rear side, and FIG. 1*c* is a sectional view taken along line A-A' shown in FIG. 1*b*.

As shown in FIGS. 1*a*-1*c*, the present exemplary embodiment is configured by sequentially stacking front sheet 11 that has flexibility, middle sheet 13, and rear sheet 12 that are composed of materials such as aluminum.

Front sheet 11 and middle sheet 13 are sealed along their four sides, whereby the area between front sheet 11 and middle sheet 13 that is enclosed by these four sides forms first housing 21. First heat storage agent 41 is accommodated in this housing 21. By sealing front sheet 11 and middle sheet 13 along their four sides, heat storage agent 41 is irremovably accommodated in housing 21.

Rear sheet 12 and middle sheet 13 are sealed along three sides but not along the upper side, and second housing 22 is formed between rear sheet 12 and middle sheet 13 with the upper side as an opening.

Hook-and-loop fastener 30 that serves as the installation part is attached on the upper portion of the side of rear sheet 12 that is opposite that of opening 22.

The method of using implement for constant-temperature storage 1 that is configured as described above is next described.

Figure 2A:
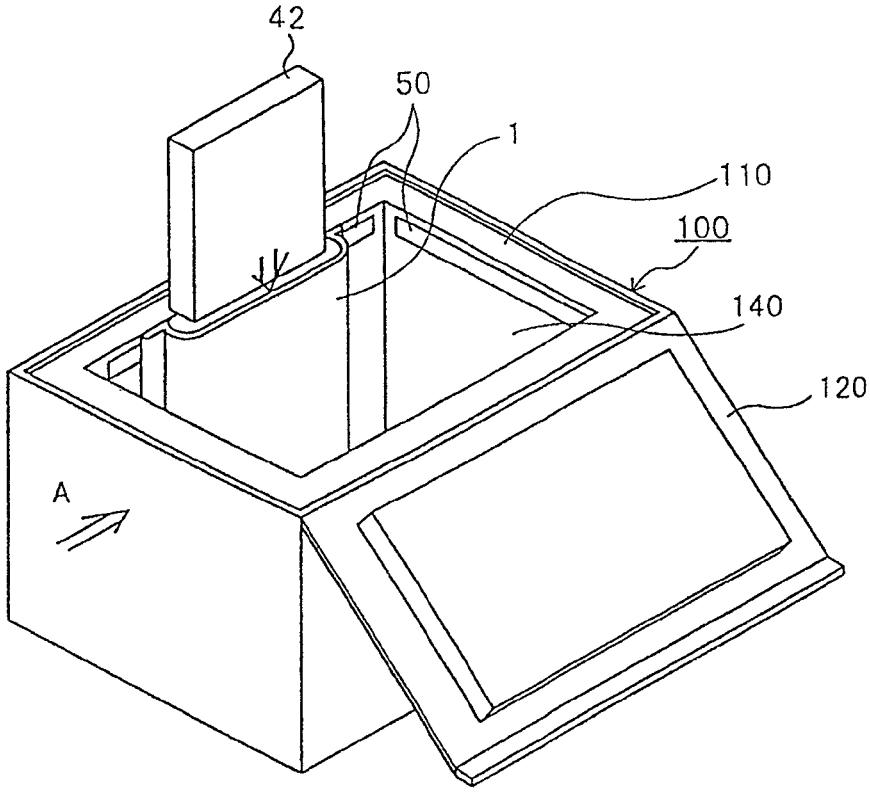
FIG. 2*a* is an outer perspective view when the implement for constant-temperature storage shown in FIGS. 1*a*-1*c* is being installed in a storage container.
Figure 2B:
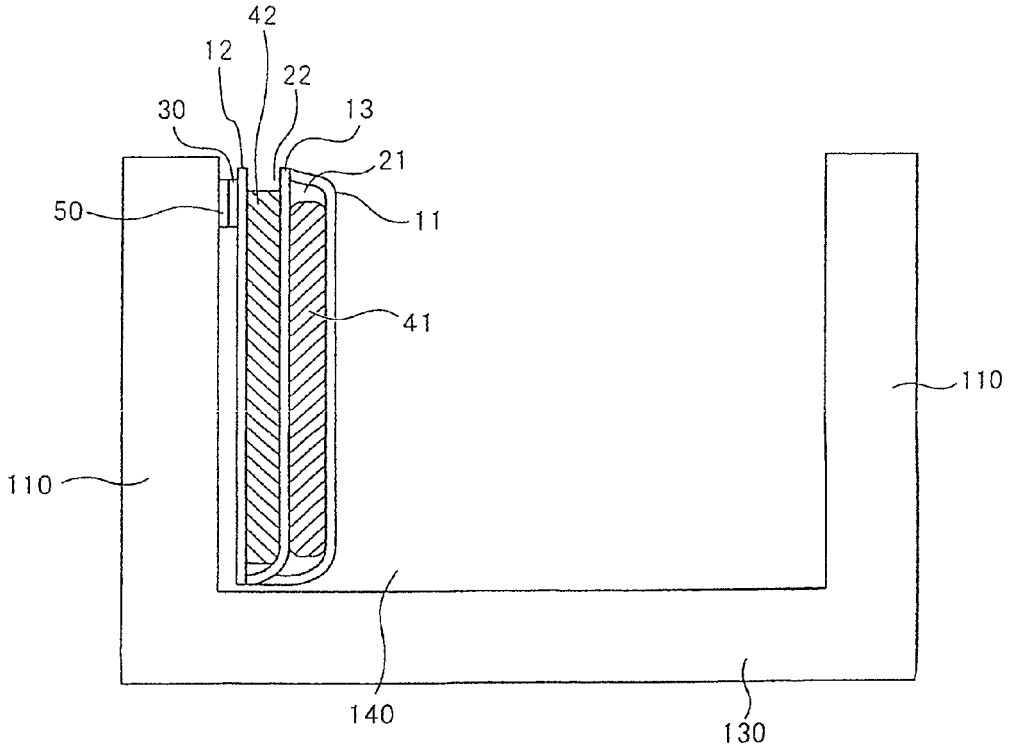
FIG. 2*b* shows the inner construction of the storage container as seen from the direction of arrow A shown in FIG. 2*a*.

FIG. 2*a* is an outer perspective view of the installation of implement for constant-temperature storage 1 shown in FIGS. 1*a*-1*c* in the storage container, and FIG. 2*b* shows the inner configuration of storage container 100 as seen from the direction of arrow A shown in FIG. 2*a*.

As shown in FIG. 2*a* and FIG. 2*b*, implement for constant-temperature storage 1 shown in FIGS. 1*a*-1*c* is installed in storage container 100 by using hook-and-loop fastener 30 that is attached to rear sheet 12. Storage container 100 has base 130 and four sidewalls 110 that rise from base 130, the area enclosed by base 130 and sidewalls 110 being storage space 140 in which a stored article is accommodated. Lid 120 is attached so as to allow opening and closing on the side opposite base 130 of storage space 140, a stored article being removed or inserted when lid 120 is in the opened state and the stored article being stored at the desired temperature when lid 120 is in the closed state. Each of the surfaces on the storage-space 140 side of base 130 and sidewalls 110 of storage container 100 constitute the inside walls in the present invention.

Hook-and-loop fasteners 50 are attached along the sides of sidewalls 110 of storage container 100 that are opposite base 130. As a result, the installing of hook-and-loop fastener 30 that is attached to rear sheet 12 of implement for constant-temperature storage 1 to these hook-and-loop fasteners 50 secures implement for constant-temperature storage 1 to sidewall 110 and installs implement for constant-temperature storage 1 in storage container 100. Hook-and-loop fastener 30 is here attached to rear sheet 12 that is on the side of housing 22 that is opposite that of housing 21, and as a result, implement for constant-temperature storage 1 is installed in storage container 100 with, housings 21 and 22, housing 21 on the side of storage space 140 and housing 22 adjacent to housing 21 on the sidewall 110 side, whereby incorrect orientation of these housings does not occur.

Second heat storage agent 42 is then placed in housing 22 of implement for constant-temperature storage 1 that is installed in storage container 100 in this way. Housing 22 is between rear sheet 12 and middle sheet 13 with the upper sides of these sheets forming an opening, and heat storage agent 42 can thus be stored from this opening. In other words, housing 22 is configured to removably accommodate heat storage agent 42. At this time, housing 21 is configured with the four sides of front sheet 11 and middle sheet 13 sealed, and heat storage agent 42 therefore cannot be placed in housing 21, whereby the incorrect placement of heat storage agent 42 in housing 21 is prevented.

Although FIGS. 2*a* and 2*b* take as an example a case in which implement for constant-temperature storage 1 is installed on one sidewall 110 of the four sidewalls 110 of storage container 100, implements for constant-temperature storage 1 may obviously also be installed on two sidewalls 110, three sidewalls 110, or all four sidewalls 110 of storage container 100.

As described hereinabove, when using implement for constant-temperature storage 1 shown in FIGS. 1*a*-1*c*, implement for constant-temperature storage 1 is installed by means of hook-and-loop fastener 30 that is attached to rear sheet 12, and the installation orientation with respect to storage container 100 therefore will not be incorrect. In addition, because one heat storage agent 41, of the two heat storage agents 21 and 22, is irremovably accommodated in housing 21, only the other heat storage agent 42 is installed in housing 22 at the time of use, and as a result, heat storage agents 41 and 42 cannot be incorrectly installed in the two housings 21 and 22. Implement for constant-temperature storage 1 is therefore installed in the correct orientation in storage container 100, and moreover, because heat storage agents 41 and 42 cannot be incorrectly inserted in the two housings 21 and 22, incorrect positioning of the two heat storage agents 41 and 42 with respect to the stored article that is accommodated in storage space 140 of storage container 100 will not occur.

The effects realized by implement for constant-temperature storage 1 that is installed in storage container 100 as described above are next described.

Figure 3:
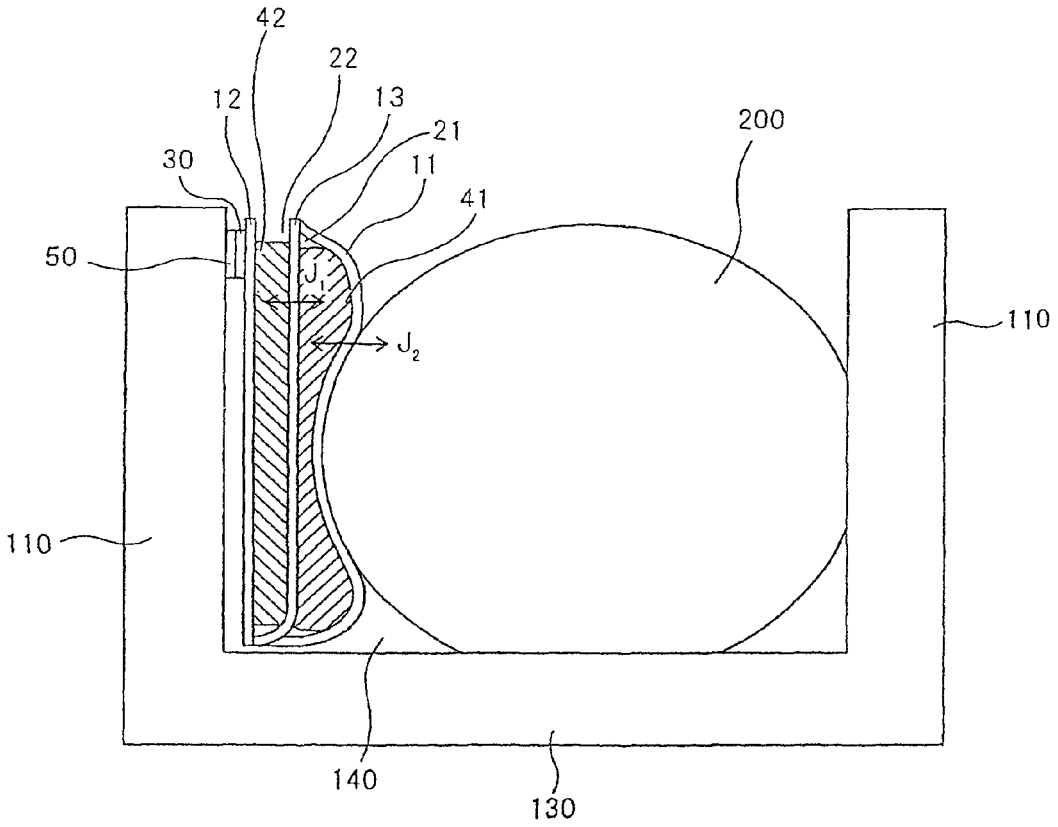
FIG. 3 is a view for describing the effect when the implement for constant-temperature storage shown in FIGS. 1*a*-1*c* is installed in the storage container as shown in FIGS. 2*a* and 2*b*.

FIG. 3 is a view for describing the effects when implement for constant-temperature storage 1 shown in FIGS. 1*a*-1*c* is installed in storage container 100 as shown in FIGS. 2*a* and 2*b*. In FIG. 3, lid 120 of storage container 100 has been omitted from the figure.

When an article such as a specimen that should not be excessively cooled is to be accommodated and stored in storage container 100 shown in FIGS. 2*a* and 2*b*, only heat storage agent 42 is frozen and used while heat storage agent 41 is not frozen. Heat storage agent 42 can be removed from housing 22 of implement for constant-temperature storage 1 and can therefore be easily cooled without taking excessive space in a freezer. In addition, since heat storage agent 41 is not frozen, even though heat storage agent 41 cannot be removed from implement for constant-temperature storage 1, there is no need to place implement for constant-temperature storage 1 in a freezer.

In this case, heat storage agent 41 is in an unfrozen state and therefore has a cushioning property, and further, because front sheet 11 has flexibility, heat storage agent 41 will be deformed according to the shape of article 200 that is accommodated in storage space 140 of storage container 100 as shown in FIG. 3, and heat storage agent 41 will therefore be in close contact with the outer surface of article 200 by way of front sheet 11 that makes up housing 21.

In a state in which article 200 is accommodated in storage space 140 in this way, the frozen state of heat storage agent 42 and the unfrozen state of heat storage agent 41 result in the cooling of heat storage agent 41 by heat storage agent 42 through the exchange of thermal energy $J_1$ between heat storage agents 41 and 42. Article 200 is then kept cool by heat storage agent 41 due to the exchange of thermal energy $J_2$ between heat storage agent 41 that has been cooled and article 200. Article 200 is thus kept cool indirectly by heat storage agent 42 that is frozen by way of heat storage agent 41 that is not frozen. The temperature of article 200 consequently will not fall below the freezing point of heat storage agent 41 that has not been frozen, and the excessive cooling of article 200 can therefore be avoided.

At this time, as has been described above, heat storage agent 41 is in close contact with the outer surface of article 200 through front sheet 11, whereby the effect of keeping article 200 cool is improved. In addition, because front sheet 11 is flexible, and further, because heat storage agent 41 is in a state having a cushioning effect, article 200 can be protected from shocks. In particular, when article 200 is accommodated in storage container 100, if the size of article 200 is equivalent to storage space 140 or if multiple articles are stuffed into storage space 140, the stored articles will receive pressure from the outside, but in such cases as well, heat storage agent 41 will serve as a cushion and can mitigate the pressure that is received.

In addition, heat storage agent 41 has no definite form when in an unfrozen state. As a result, if storage container 100 is tilted or if implement for constant-temperature storage 1 is attached to the inside wall surface of lid 120, the concern arises that heat storage agent 41 will accidentally come loose from implement for constant-temperature storage 1 due to vibration or shaking. However, because heat storage agent 41 that is not frozen is irremovably accommodated in housing 21, there is no chance of its accidentally coming loose from implement for constant-temperature storage 1.

A case has been described by way of example in the present exemplary embodiment in which, when an article that should not be excessively cooled is to be stored and held as article 200 in storage container 100, only heat storage agent 42 is frozen and heat storage agent 41 is not frozen, whereby heat storage agent 42 that has been frozen indirectly keeps article 200 cool by way of heat storage agent 41 that has not been frozen. However, under the opposite circumstances of a cold region, two heat storage agents 41 and 42 can be used to store the stored article that is accommodated in storage container 100 at a desired temperature that is higher than the outside temperature. Such a case would be, for example, when a stored article such as a specimen that should not be excessively cooled is to be stored in a sub-zero environment.

In this case, heat storage agent 41 that is accommodated in housing 21 is cooled to establish a frozen state, and heat storage agent 42 that is not frozen and that has been left at room temperature of 10° C.-20° C. is accommodated in housing 22.

The consequent frozen state of heat storage agent 41 and unfrozen state of heat storage agent 42 results in the exchange of thermal energy between heat storage agents 41 and 42 and a rise in the temperature of heat storage agent 41. The temperature of heat storage agent 41 becomes uniform in the vicinity of the melting point, whereby the stored article is stored at a temperature in the vicinity of the melting point of heat storage agent 41.

Another Embodiment

Figure 4A:
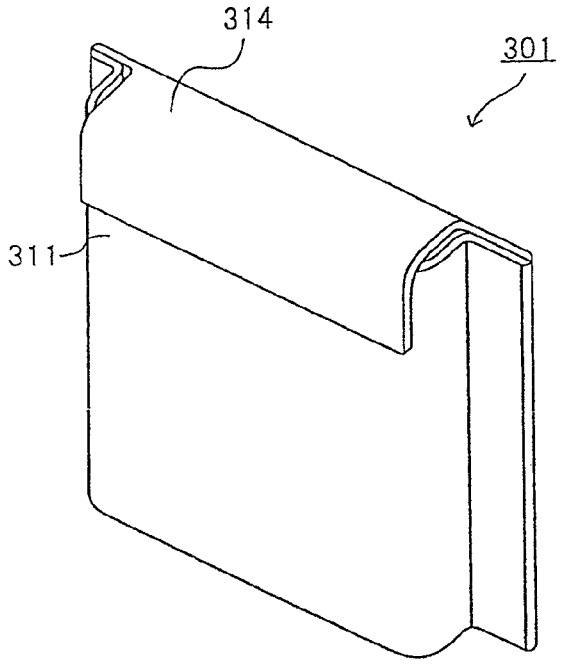
FIG. 4*a* is an outer perspective view showing another exemplary embodiment of the implement for constant-temperature storage of the present invention.
Figure 4B:
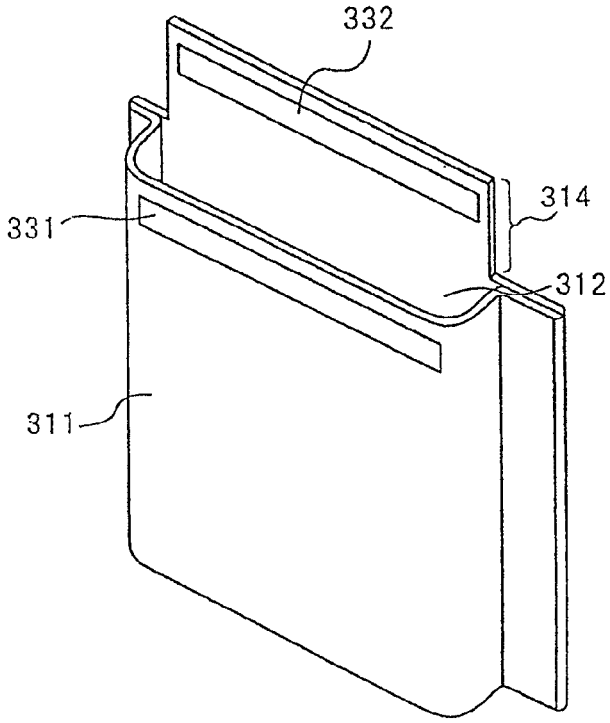
FIG. 4*b* is an outer perspective view showing the other exemplary embodiment of the implement for constant-temperature storage of the present invention.
Figure 4C:
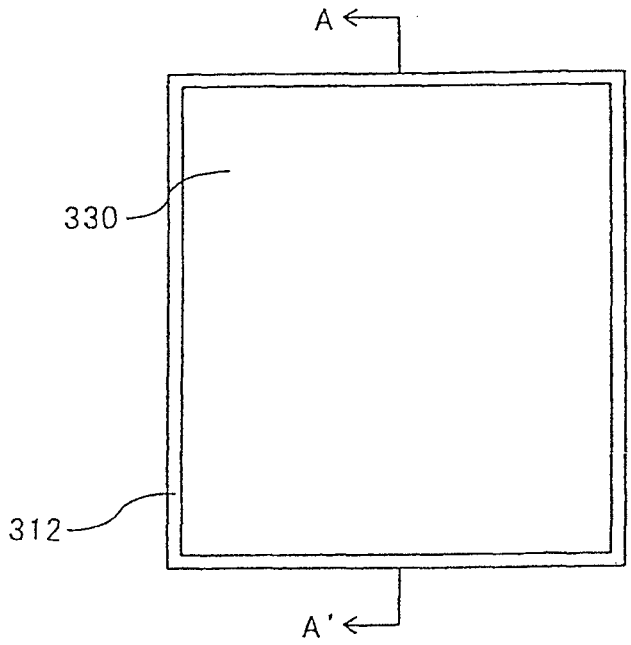
FIG. 4*c* is a view as seen from the rear side of the implement for constant-temperature storage shown in FIG. 4*a* and FIG. 4*b*.
Figure 4D:
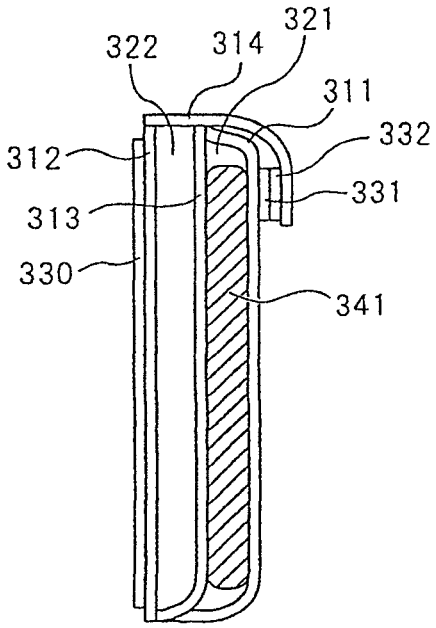
FIG. 4*d* is a sectional view taken along line A-A' shown in FIG. 4*c*.

FIGS. 4*a* and 4*b* are outer perspective views showing another exemplary embodiment of the implement for constant-temperature storage of the present invention, FIG. 4*c* shows the implement for constant-temperature storage shown in FIGS. 4*a* and 4*b* as seen from the rear, and FIG. 4*d* is a sectional view taken along line A-A' shown in FIG. 4*c*.

As shown in FIGS. 4*a*-4*d*, the present exemplary embodiment differs from the implement shown in FIGS. 1*a*-1*c* in that: rear sheet 312 includes cover 314 that extends to the opening side of housing 322; hook-and-loop fasteners 331 and 332 are provided on each of the areas of front sheet 311 and rear sheet 312 that face each other when cover 314 is folded over, and further, hook-and-loop fastener 330 is provided on, of the surface of rear sheet 312 that is on the side opposite that of housing 322, the entire surface except for cover 314.

In implement for constant-temperature storage 301 that is configured as described above, heat storage agent is accommodated in housing 322 with cover 314 in the wide-open state as shown in FIG. 4*b*, following which, by folding over cover 314 and adhering hook-and-loop fastener 332 of cover 314 to hook-and-loop fastener 331 of front sheet 311 as shown in FIG. 4*a*, the heat storage agent can be prevented from falling out of housing 322. Further, by providing hook-and-loop fastener 330 to, of the surface of rear sheet 312 on the side opposite housing 322, the entire surface except for cover 314, and by similarly providing a hook-and-loop fastener over the entire surface of the inside wall surfaces of the storage container, and then adhering these hook-and-loop fasteners together, implement for constant-temperature storage 301 can be securely installed in the storage container.

Although cases have been described by way of example in the above-described exemplary embodiments in which hook-and-loop fasteners 30 and 330 were used as the installation parts for attaching the implements for constant-temperature storage 1 and 301 to a storage container, the installation parts are not limited to hook-and-loop fasteners as long as they are elements on the surfaces of rear sheets 12 and 312 that are opposite housings 22 and 322 that are attached to the storage container.

What is claimed is:

1. An implement for constant-temperature storage that is installed on the inside wall surface of a storage container that accommodates a stored article, comprising:

a first housing in which a first heat storage agent is irremovably accommodated; and a second housing that is adjacent to a side of said inside wall surface of said first housing when the implement for constant-temperature storage is installed in said storage container and in which a second heat storage agent is removably accommodated;

wherein said second housing is provided with installation parts on the outer surface of the side that is opposite said first housing in order to install said implement for constant-temperature storage in said storage container.

2. The implement for constant-temperature storage as set forth in claim 1, wherein:

the first or second heat storage agent is frozen and the remaining heat storage is not frozen.

3. A storage container in which the implement for constant-temperature storage as set forth in claim 1 is installed.

4. A storage container in which the implement for constant-temperature storage as set forth in claim 2 is installed.

5. The implement for constant-temperature storage as set forth in claim 2, wherein:

said first heat storage agent is not frozen and has a cushioning property;

wherein the surface of said first housing that is opposite the side of said second housing is flexible.

6. A storage container in which the implement for constant-temperature storage as set forth in claim 5 is installed.

* * * * *